US009949516B2

(12) United States Patent
Pickett

(10) Patent No.: US 9,949,516 B2
(45) Date of Patent: Apr. 24, 2018

(54) INTERACTIVE HELMET SYSTEM AND METHOD

(71) Applicant: Joshua R&D Technologies, LLC, Plano, TX (US)

(72) Inventor: David Pickett, Plano, TX (US)

(73) Assignee: Joshua R&D Technologies, LLC, Plano, TX (US)

( * ) Notice: Subject to any disclaimer, the term of this patent is extended or adjusted under 35 U.S.C. 154(b) by 0 days.

(21) Appl. No.: 15/225,514

(22) Filed: Aug. 1, 2016

(65) Prior Publication Data

US 2018/0027895 A1 Feb. 1, 2018

(51) Int. Cl.

| | |
|---|---|
| ***A41D 13/018*** | (2006.01) |
| ***A42B 3/06*** | (2006.01) |
| ***A42B 3/08*** | (2006.01) |
| ***A42B 3/12*** | (2006.01) |
| ***A63B 71/08*** | (2006.01) |

(52) U.S. Cl.

CPC ..... *A41D 13/018* (2013.01); *A42B 3/063* (2013.01); *A42B 3/08* (2013.01); *A42B 3/122* (2013.01); *A42B 3/125* (2013.01); *A63B 71/081* (2013.01); *A63B 2220/53* (2013.01); *A63B 2220/56* (2013.01)

(58) Field of Classification Search

CPC ..... A42B 3/063; A42B 3/08; A42B 3/122; A42B 3/125; A42B 3/0486; A42B 3/046; A42B 3/121; A42B 3/06; A41D 13/018; A63B 2220/53; A63B 2220/56; A63B 71/081

USPC ..... 2/412, 411, 413, 414, DIG. 3

See application file for complete search history.

(56) References Cited

U.S. PATENT DOCUMENTS

| | | | | |
|---|---|---|---|---|
| 4,663,785 | A | 5/1987 | Comparetto | |
| 5,263,203 | A * | 11/1993 | Kraemer | A42B 3/122 2/413 |
| 6,032,299 | A * | 3/2000 | Welsh | A41D 13/018 2/456 |
| 6,681,408 | B2 * | 1/2004 | Ku | A42B 3/122 2/411 |
| 6,729,643 | B1 * | 5/2004 | Bassick | A41D 13/0512 2/413 |
| 7,596,817 | B2 * | 10/2009 | Krapiva | A42B 3/0486 2/411 |
| 8,127,373 | B1 * | 3/2012 | Fodemski | A42B 3/046 2/410 |
| 8,402,568 | B2 | 3/2013 | Alstin et al. | |
| 8,719,967 | B2 * | 5/2014 | Milsom | A42B 3/122 2/411 |

(Continued)

*Primary Examiner* — Khoa Huynh
*Assistant Examiner* — Griffin Hall
(74) *Attorney, Agent, or Firm* — Kirby B. Drake; Klemchuk LLP

(57) ABSTRACT

An interactive helmet system and method for reducing brain injuries may provide a helmet and at least one inflatable air pouch. The at least one inflatable air pouch may remain in an active position and may pressurize or further inflate in response to an impact with a surface. Over a predetermined time period, the at least one inflatable air pouch may not depressurize and may instantly pressurize or further inflate. The at least one inflatable air pouch may have an air pouch pressure that increases to a higher pressure and may protect users from brain injury at high impact forces.

14 Claims, 6 Drawing Sheets

(56) References Cited

U.S. PATENT DOCUMENTS

| | | | | |
|---|---|---|---|---|
| 9,027,170 | B2 * | 5/2015 | Dainese | A41D 13/018 2/455 |
| 2006/0038694 | A1 | 2/2006 | Naunheim et al. | |
| 2007/0056081 | A1 * | 3/2007 | Aspray | A42B 3/067 2/411 |
| 2009/0254003 | A1 * | 10/2009 | Buckman | A61B 5/1117 600/595 |
| 2013/0019374 | A1 * | 1/2013 | Schwartz | A61F 5/00 2/69 |
| 2013/0118255 | A1 | 5/2013 | Callsen et al. | |
| 2013/0340150 | A1 | 12/2013 | Brantley | |
| 2014/0000011 | A1 * | 1/2014 | Johnson | A42B 3/121 2/413 |
| 2014/0035266 | A1 * | 2/2014 | Arzanpour | A42B 3/0486 280/742 |
| 2014/0208486 | A1 | 7/2014 | Krueger | |
| 2014/0327234 | A1 | 11/2014 | Heurlin et al. | |
| 2015/0257471 | A1 * | 9/2015 | Warmouth | A42B 3/122 2/413 |
| 2015/0374060 | A1 * | 12/2015 | Morgan | A42B 1/046 2/413 |
| 2016/0053843 | A1 * | 2/2016 | Subhash | A42B 3/121 2/413 |
| 2016/0120238 | A1 * | 5/2016 | Duncan | A41D 13/018 2/462 |
| 2016/0143383 | A1 * | 5/2016 | Allen | A42B 3/0486 2/413 |
| 2017/0035139 | A1 * | 2/2017 | Weatherby | A63B 71/081 |
| 2017/0042271 | A1 * | 2/2017 | Tuttle | A42B 3/121 |
| 2017/0143055 | A1 * | 5/2017 | Duncan | A41D 13/018 |
| 2017/0189786 | A1 * | 7/2017 | Riggs | A63B 71/081 |
| 2017/0196293 | A1 * | 7/2017 | Podboy | A42B 3/122 |

* cited by examiner

INTERACTIVE HELMET SYSTEM AND METHOD

FIELD OF THE DISCLOSURE

The present disclosure generally relates to helmets. In particular, the disclosure relates to interactive helmets responsive to impacts against surfaces.

BACKGROUND

During contact sports and other physical activities, helmets have long been worn to protect users from sustaining injuries to the head and brain. Over time, helmets have become lighter and have provided additional cushioning to help better protect users. However, lighter helmets offer less protection for a user's head and brain, and additional cushioning can be ineffective. Being injured while wearing conventional helmets can result in serious injuries including sustaining a concussion and chronic traumatic encephalopathy (CTE) brain damage. As athletes experience long and short-term brain injuries resulting from head impacts, there is a need for more effective helmets. Short-term brain injuries typically result from hard falls, impact with objects, and helmet-to-helmet contact. While there are protocols in place to protect players from concussions, repeatedly experiencing concussions can result in brain damage which can be detected by medical resonance imaging (MRIs) and autopsies of athletes who have sustained multiple concussions. Consequently, traditional helmets have many shortcomings and do not fully protect users.

SUMMARY

Embodiments of the present disclosure may provide an interactive helmet system for reducing brain injuries. The system may include at least one inflatable air pouch that may be provided in an interior of a helmet in an active position. An air pouch pressure may increase over a predetermined inflation time, and the at least one inflatable air pouch may not depressurize in the active position. The system may include a force measuring instrument that may be provided in the interior of the helmet to predetermine an impact force of the helmet against a surface. The air pouch pressure may increase in proportion to the force. The system may further include an inflation device that may be provided in the interior of the helmet to initiate inflating the at least one inflatable air pouch. The system may include a pressure sensor that may be provided in the interior of the helmet to monitor the air pouch pressure of the at least one inflatable air pouch. A pressure regulator may control and maintain the air pouch pressure at or above a predetermined pressure. The air pouch pressure may increase to a maximum of approximately twice the predetermined pressure. The predetermined inflation time may be from approximately 0.01 to 0.5 seconds following an impact of the helmet against the surface. The inflation device may provide a signal to at least one valve that may control a flow of gas into the at least one inflatable air pouch. The system may include additional inflatable air pouches that may be provided in the interior of the helmet in the active position. The force measuring instrument may be a force gauge and/or a rupture disc. The inflation device may be actuated mechanically without utilizing electronics upon undergoing the predetermined impact force.

The system may include a strap that may be provided to support at least one of a user's chin and jaw. The strap may include the at least one inflatable air pouch that may be arranged to prevent injuries. An internal helmet cushioning material may be provided to harden or soften as an electrical current may be applied to the interactive helmet system. An internal helmet cushioning material may be provided to harden as an impact may increase. The impact may result from physical forces that may be applied to the interactive helmet system.

Embodiments of the present disclosure may provide a method of reducing brain injuries using an interactive helmet. The method may provide arranging at least one inflatable air pouch in an active position in an interior of a helmet. The method may further provide determining an impact force of the helmet against a surface using a force measuring instrument. The method may provide initiating inflation of the at least one inflatable air pouch using an inflation device for a predetermined inflation time. The method may also provide monitoring the air pouch pressure of the at least one inflatable air pouch after initiating inflation using a pressure sensor, and maintaining the air pouch pressure at or above the predetermined pressure using a pressure regulator. The predetermined inflation time may be approximately 0.01 to 0.5 seconds following an impact of the helmet against the surface. The method may include providing a signal to at least one valve using the inflation device that may control a flow of air or gas into the at least one inflatable air pouch. The method may provide arranging additional inflatable air pouches in the interior of the helmet in the active position. The impact force of the helmet against a surface may be predetermined using a force gauge and/or a rupture disc. The inflation device may be actuated mechanically without utilizing electronics upon undergoing the predetermined impact force. The method may provide arranging the at least one inflatable air pouch in an active position in a strap that may be provided to support at least one of a user's chin and jaw. The method may provide arranging an internal helmet cushioning material in the interior of the helmet system. The internal helmet cushioning material may harden or soften as an electrical current may be applied to the interactive helmet system. The method may provide arranging an internal helmet cushioning material in the interior of the helmet system. The internal helmet cushioning may harden as an impact may increase. The impact may result from physical forces that may be applied to the interactive helmet system.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The present disclosure generally provides an interactive helmet system and method for reducing concussions and brain injuries that may result from head impacts.

Figure 1A:
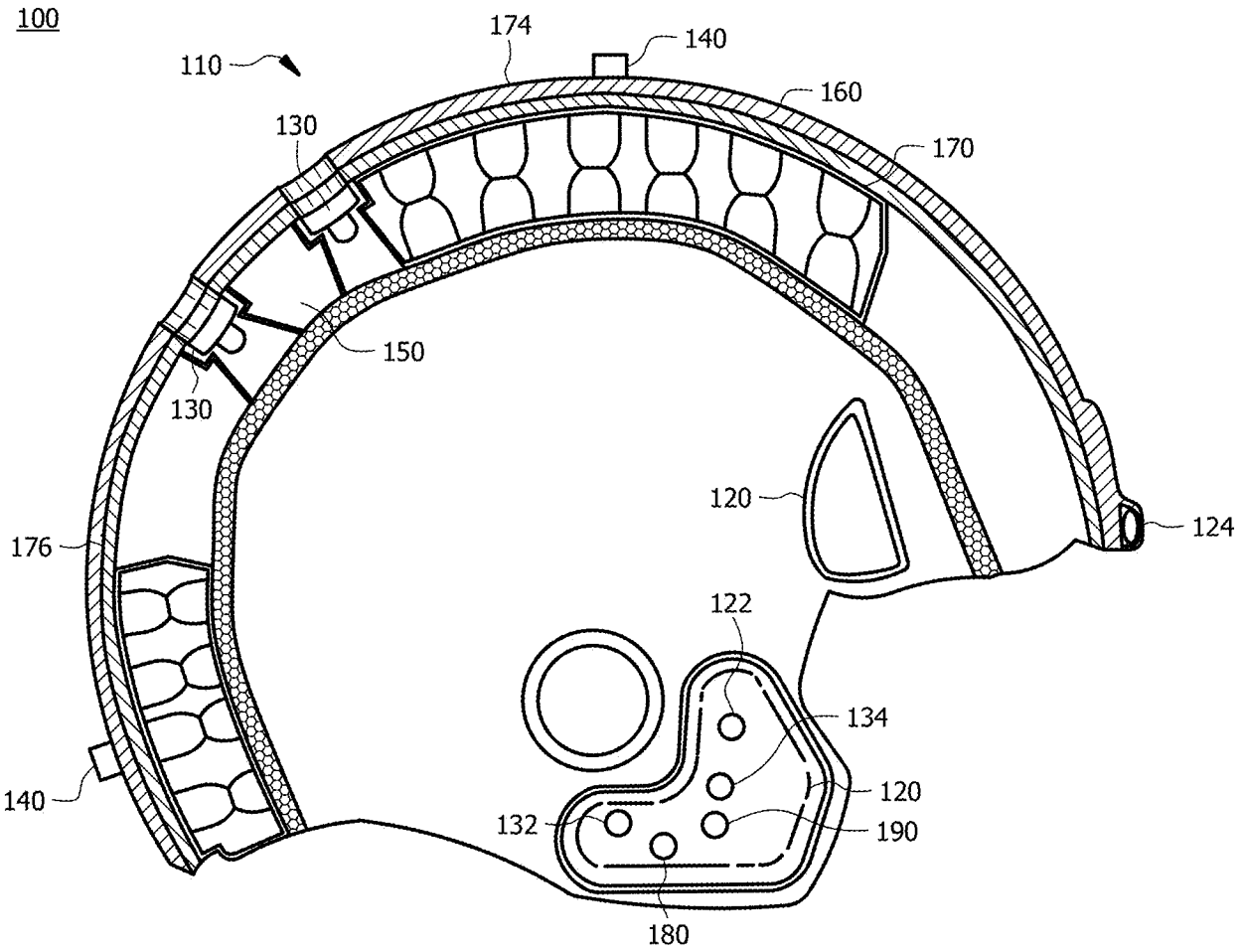
FIG. 1A depicts an interactive helmet system showing the interior of a helmet according to an embodiment of the present disclosure.
Figure 2:
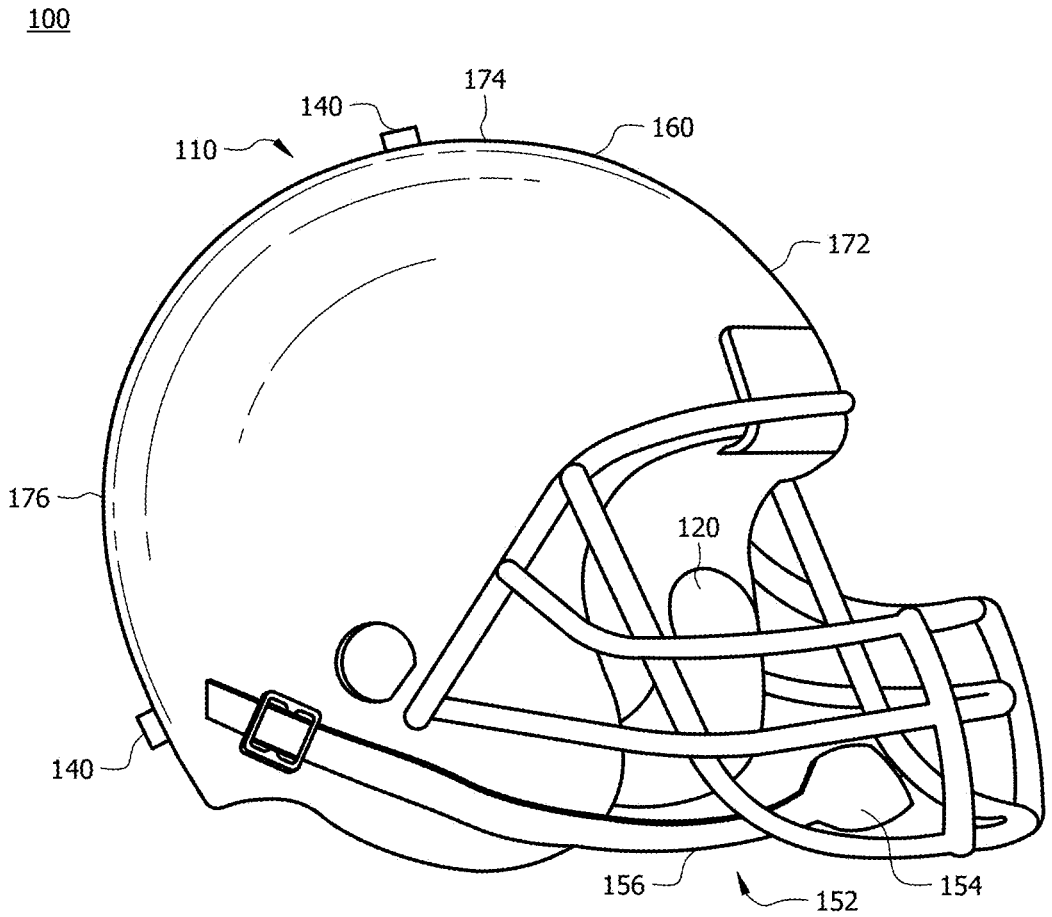
FIG. 2 depicts an interactive helmet system showing the exterior of a helmet according to an embodiment of the present disclosure.

According to an embodiment of the present disclosure, FIG. 1A illustrates interactive helmet system 100 that may provide protection from brain trauma or injuries that may result from a hard impact of helmet 110 against a surface. It should be appreciated that a hard impact may include, but is not limited to, helmet 110 colliding against another object at a force that may be greater than a predetermined force. It should be appreciated that a hard impact may provide an impact of helmet 110 colliding against another object at a force that may fail to comply with manufacturing specifications provided for conventional helmets that are set to protect against injuries. It should further be appreciated that a hard impact may provide an impact of helmet 110 colliding against another object at a force that may cause brain trauma and/or at a force that may exceed approximately 30 G's. It should also be appreciated that the surface in which helmet 110 may make a hard impact may include, but is not limited to, the ground, an object, a wall, a person or an extension of a person, and/or another helmet system or helmet. Interactive helmet system 100 may include helmet 110, at least one inflatable air pouch 120, force gauge 122, indicator 124, pressure sensor 132, pressure regulator 134, at least one valve 130, at least one filler port 140, inflation device 150, and strap 152 (FIG. 2). While these components have been depicted in a certain placement in the Figures, it should be appreciated that their placement within interactive helmet system 100 may change without departing from the present disclosure. Helmet 110 may provide shell 160 that may include interior 170 and exterior 172 (FIG. 2), and helmet 110 may provide top 174 and rear 176. It should be appreciated that helmet 110 may provide a head circumference that may provide a proper fit and protection to a user of helmet 110. It should further be appreciated that a proper fit of helmet 110 on a user's head may provide greater protection to a user than an improper fit of helmet 110.

A force measuring instrument including, but not limited to, force gauge 122, may include indicator 124 that may provide whether at least one inflatable air pouch 120 has been inflated to a pressure in which at least one inflatable air pouch 120 needs to be replaced and helmet 110 is inoperable. A force measuring instrument, such as force gauge 122 and rupture disc 126 (FIG. 1B), may be provided in interior 170 of helmet 110 at a location that may contact the crown of a user's head. It should be appreciated that any quantity of force gauges may be provided in helmet 110. It should further be appreciated that force gauge 120 may be arranged at any location of interior 170 that will best protect a user from sustaining an injury and at any location that may be determined by an original equipment manufacturer (OEM). It should be appreciated that force gauge 122 may not be provided in helmet 110 in some embodiments of the present disclosure. An inflation device for controlling and inflating at least one inflatable air pouch 120 may actuate mechanically without utilizing electronics upon helmet 110 undergoing a predetermined impact force.

It should also be appreciated that interior 170 may include at least one proximity sensor 180 that may predict when an impact may be expected to occur from any angle in some embodiments of the present disclosure. For example, proximity sensor 180 may predict that an impact will occur within 10 seconds along a right side of helmet 110 and may inflate at least one inflatable air pouch 120. It should be appreciated that at least one inflatable air pouch 120 may include some air in an active position, as further described below, and may further inflate when an impact is predicted to occur.

Figure 1B:
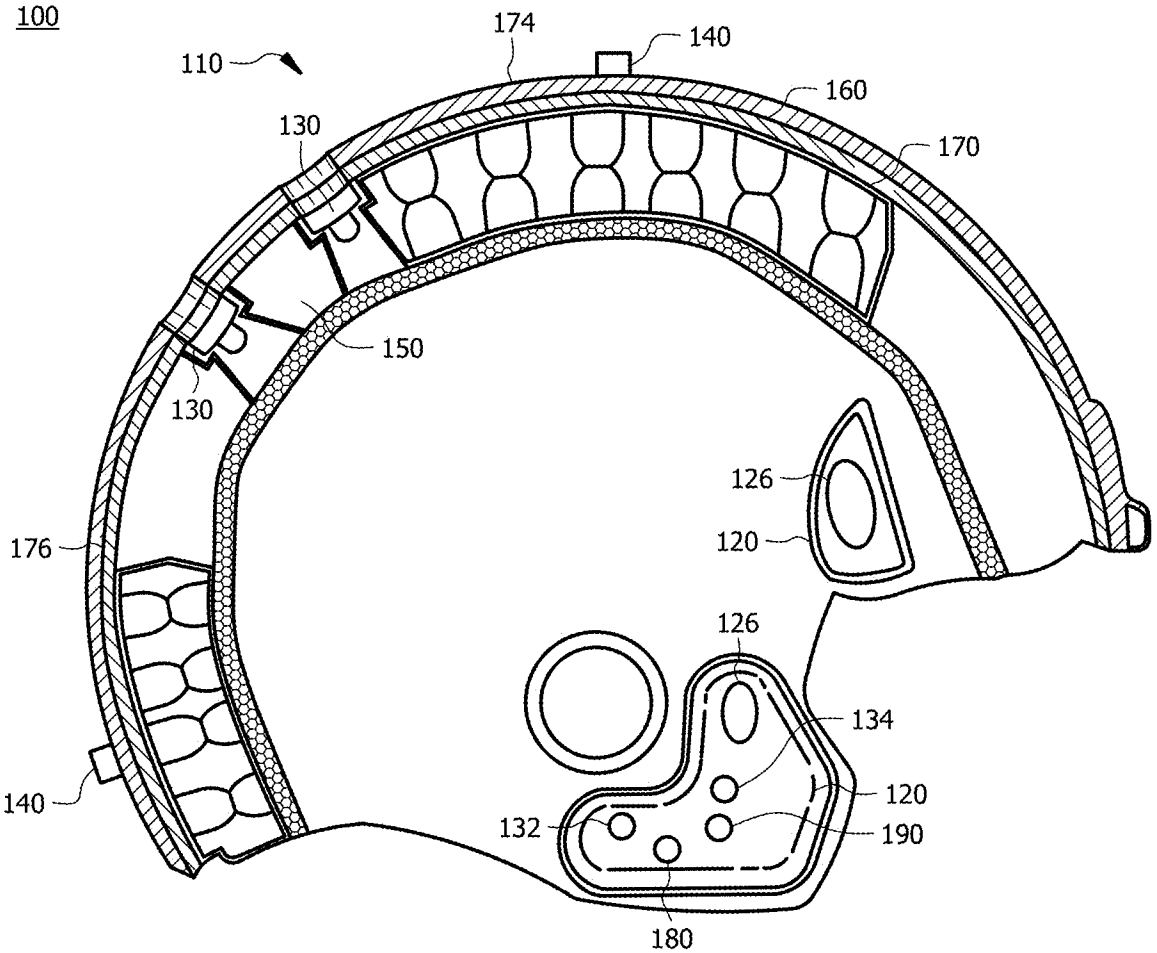
FIG. 1B depicts an interactive helmet system showing the interior of a helmet according to another embodiment of the present disclosure.

According to an embodiment of the present disclosure, FIG. 1B illustrates interactive helmet system 100 that may provide protection from brain trauma or injuries that may result from a hard impact of helmet 110 against a surface. A force measuring instrument including, but not limited, to, rupture disc 126, may be provided in helmet 110 to inflate at least one inflatable air pouch 120. Rupture disc 126 may be a chemical inflation device that may inflate at least one inflatable air pouch 120 to a predetermined pressure and may measure a force that may be generated when helmet 110 collides against another object. It should further be appreciated rupture disc 126 may not be provided in helmet 110 in some embodiments of the present disclosure.

At least one inflatable air pouch 120 may be provided in interior 170 of helmet 110 proximate a user's ear and/or forehead. It should be appreciated that at least one inflatable air pouch 120 may be provided at other locations in interior 170 of helmet 110 without departing from the present disclosure. At least one inflatable air pouch 120 may be arranged in an active position 210 (FIG. 4) in an embodiment of the present disclosure. It should be appreciated that an active position of at least one inflatable air pouch 120 may be a position in which at least one inflatable air pouch 120 remains inflated. It should further be appreciated that at least one inflatable air pouch 120 may be provided at any location along helmet 110 without departing from the present disclosure. At least one inflatable air pouch 120 may have an air pressure that may increase over a predetermined inflation time during pressurization or inflation. The predetermined inflation time may range from approximately 0.01 to 0.5 seconds after a hard impact of helmet 110 against a surface. At least one inflatable air pouch 120 may provide a shape, size, volume that may provide optimal protection to a user from injury. For example, at least one inflatable air pouch 120 may provide a round shape that may be approximately two inches in diameter. At least one inflatable air pouch 120 may provide enough empty space for increasing the inflation pressure of at least one inflatable air pouch 120. It should be appreciated that by how much at least one inflatable air pouch 120 is increased may depend on factors, including but not limited to, the OEM specifications and/or a user's head size.

Following an impact of helmet 110 against a surface, automatic or instant inflation of at least one inflatable air pouch 120 may occur. It should be appreciated that the predetermined inflation time may be less than approximately 0.01 seconds and/or greater than approximately 0.5 seconds without departing from the present disclosure. It should further be appreciated that any quantity of at least one inflatable air pouch 120 may be incorporated into interior 170 of helmet 110 without departing from the present disclosure. It should also be appreciated that helmet 110 may be a football helmet without departing from the present disclosure.

It should be appreciated that helmet 110 may be a device for other sports, occupations, recreation, and the military without departing from the present disclosure. It should further be appreciated that at least one inflatable air pouch 120, force gauge 122, rupture disc 126, pressure sensor 132, pressure regulator 134, at least one valve 130, at least one filler port 140, and/or inflation device 150 may be incorporated into helmets or headgear.

Figure 3:
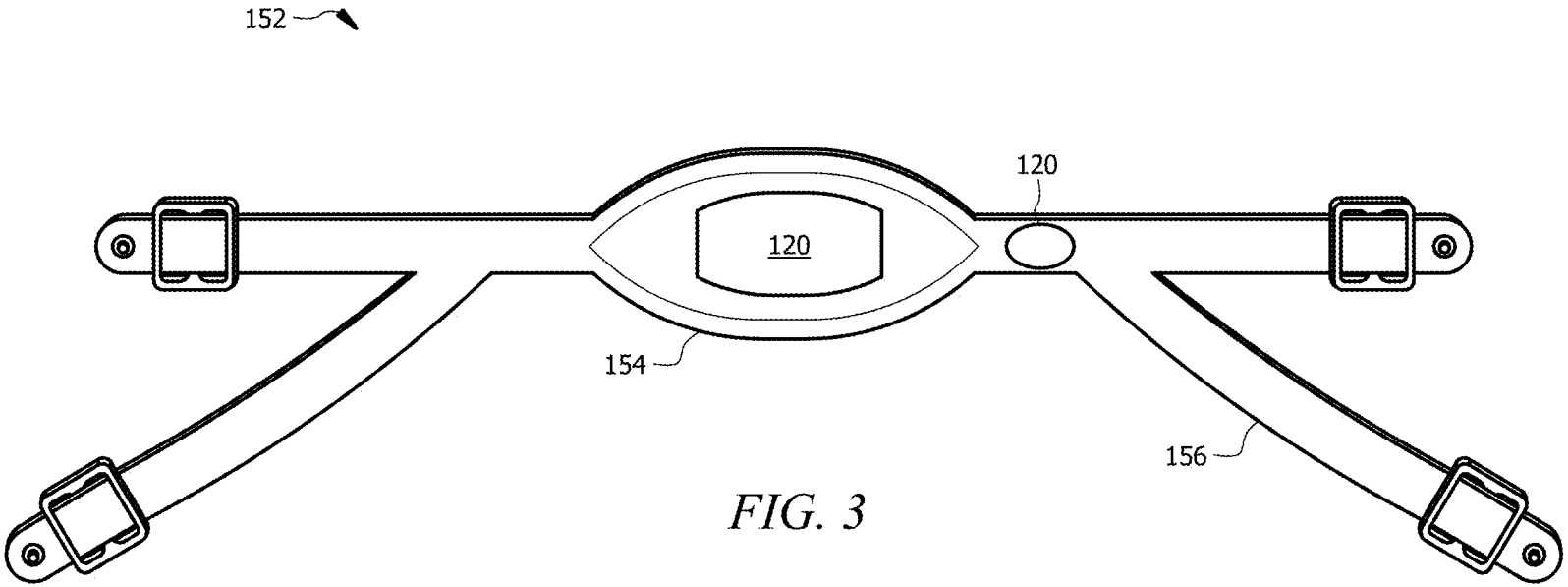
FIG. 3 depicts another view of the exterior of a helmet according to an embodiment of the present disclosure.

According to an embodiment of the present disclosure, FIG. 2 illustrates exterior 172 of helmet 110 and strap 152 (FIG. 3). Exterior 172 may provide indicator 124 of force gauge 122 (FIG. 1A). Indicator 124 may be arranged about exterior 172 and may indicate when at least one inflatable air pouch 120 has reached a predetermined pressure. When at least one inflatable air pouch 120 has reached a predetermined pressure, indicator 124 may provide a visual and/or audible alarm. It should be appreciated that the visual and/or audible alarm may include, but is not limited to, a spring-operated or pop-up indicator, a color indicator, an audible sound, and combinations of the same.

Strap 152 may be provided to support a user's chin and/or jaw with chin portion 154 and/or jaw portion 156 (FIG. 3). Strap 152 may include at least one inflatable air pouch 120 that may be arranged in the active position on chin portion 154 and/or jaw portion 156. It should be appreciated that the at least one inflatable air pouch 120 that may be provided on chin portion 154 and the at least one inflatable air pouch 120 that may be provided on jaw portion 156 may inflate simultaneously and may provide protection from impacts at any angle, position, and/or direction.

Figure 4:
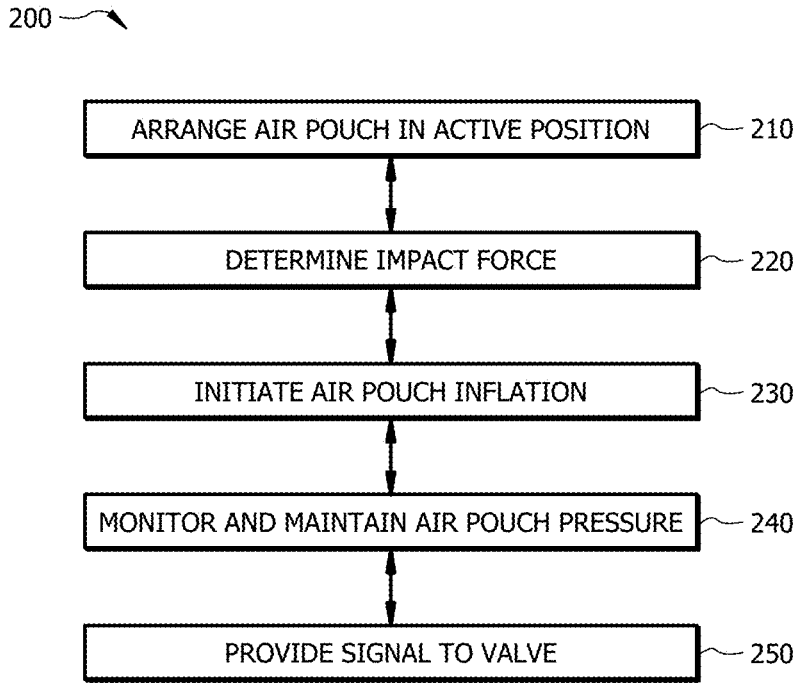
FIG. 4 depicts a method of reducing brain injuries using an interactive helmet system according to an embodiment of the present disclosure.

According to an embodiment of the present disclosure, FIG. 4 depicts a method for using interactive helmet system 100 (FIGS. 1A, 1B, and 2). In step 210, least one inflatable air pouch 120 may be arranged in an active position in interior 170 (FIGS. 1A and 1B) of helmet 110 (FIGS. 1A, 1B, and 2). An impact force of helmet 110 against a surface may be determined using force gauge 122 (FIG. 1A) and/or rupture disc (FIG. 1B) in step 220. Pressure sensor 132 may be provided in interior 170 of helmet 110 and may detect the gravitational force or impact G's between helmet 110 and a surface. When pressure sensor 132 detects impact G's or an impact force (step 220), pressure sensor 132 may provide a signal to inflation device 150 (FIG. 1A) that may initiate inflation of at least one inflatable air pouch 120 (FIGS. 1A, 1B, and 2) to a predetermined air pouch pressure in step 230. In step 240, monitoring of pressure in at least one inflatable air pouch 120 may occur using pressure regulator 134 to ensure that it may remain at least partially inflated in an active position without depressurizing. An active position of at least one inflatable air pouch 120 may remain inflated in an embodiment of the present disclosure. It should be appreciated that an active position may remain active prior to an impact and may not include depressurizing or deflating at least one inflatable air pouch 120 in some embodiments of the present disclosure. It should further be appreciated that instant inflation may occur when a preset impact may be detected. It should be appreciated that a preset impact may be determined by parameters including, but not limited to, a reference voltage for a comparator and an acceleration of interactive helmet system 100, in which the reference voltage may be linearly proportional to acceleration. Inflation device 150 may send a signal to at least one valve 130 (FIGS. 1A and 1B) in step 250 and this may initiate inflation of air into at least one air inflatable air pouch 120. A flow of air into at least one inflatable air pouch 120 may be controlled by at least one valve 130.

Figure 5:
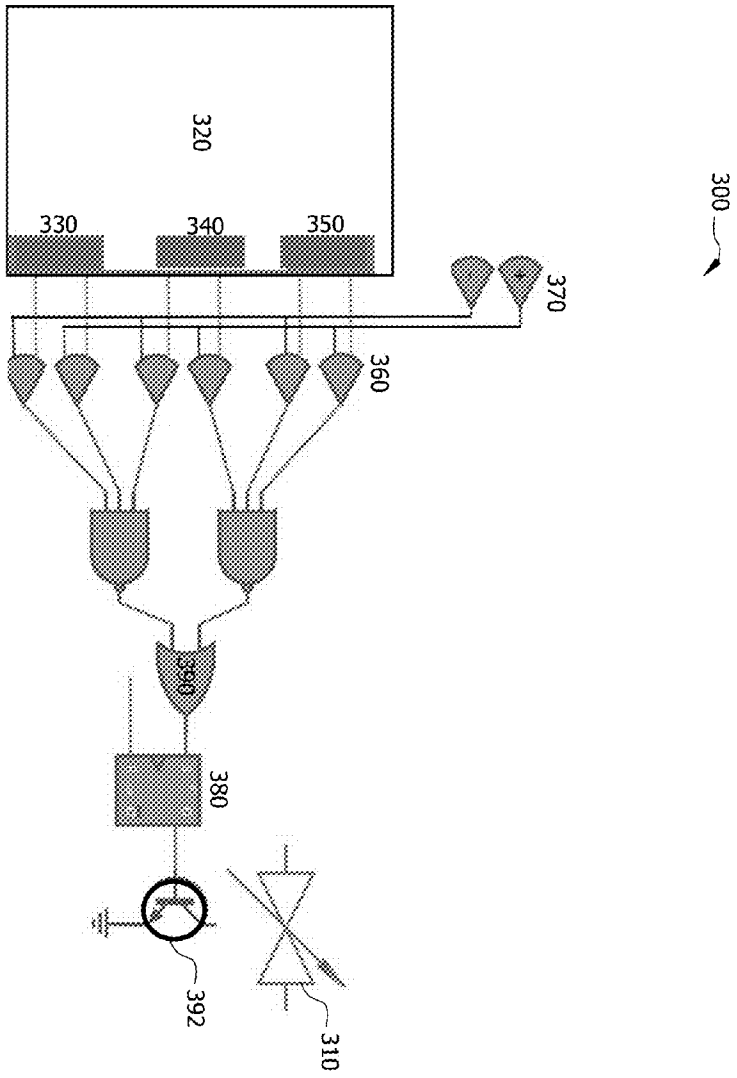
FIG. 5 depicts a block diagram including electronic equipment for controlling and inflating an inflatable air pouch.

According to an embodiment of the present disclosure, FIG. 5 depicts block diagram 300 representing electronic equipment for controlling and inflating at least one inflatable air pouch 120 (FIGS. 1-3). An inflation of at least one inflatable air pouch 120 (FIGS. 1-3) may be controlled by external $CO_2$ and/or gas cartridge 310 and micro-electro mechanical system (MEMs)-based accelerometer 320. MEMS-based accelerometer 320 may sense acceleration in three axes X-330, Y-340, and Z-350 and may output a voltage that may be proportional to the acceleration. Three voltage outputs of MEMs-based accelerometer 320 may correspond to X-330, Y-340, and Z-350, respectively, and may be filtered by bandpass filters (not shown). It should be appreciated that bandpass filters may remove high frequency noise and DC offsets from sensors. Six-channel analog comparator 360 may compare the voltage outputs of MEMs-based accelerometer 320 to threshold voltage 370 that may be hard set via a resistor divider and/or a voltage reference or via a potentiometer. It should be appreciated that voltage thresholds may be provided for positive and negative G-forces. Comparator 360 may output a signal when any axes exceeds threshold voltage 370, whether the voltage is positive or negative, and may route the signal to six-input NAND equivalent circuit 392. The output of six-input NAND equivalent circuit 392 or a gate array may trigger flip-flop circuit 380 which may remain in an enabled state until electronic equipment can be reset using reset 390. It should be appreciated that reset 390 may be power cycled or an external reset. The output of flip-flop circuit 390 may trigger a transistor output and may trigger a simple solenoid valve (not shown) to enable external $CO_2$ cartridge 310 to inflate at least one inflatable air pouch 120 (FIGS. 1-3). An inflation device for controlling and inflating at least one inflatable air pouch 120 may actuate mechanically without utilizing electronics upon helmet 110 undergoing a predetermined impact force.

It should be appreciated that the at least one inflatable air pouch 120 may include a pressure level that may protect a user's brain against impacts of up to approximately 100 G's. It should further be appreciated that helmet 110 may instantly inflate to a preset higher pressure after inflation device 150 provides a signal to at least one valve 130. It should also be appreciated that a preset higher pressure may be a pressure that is approximately twice an initial pressure in an embodiment of the present disclosure; however, it may be higher or lower without departing from the present disclosure. It should be appreciated that mechanical valve 190 may automatically or instantly inflate at least one air pouch 120 to a preset higher air pressure than an initial air pressure that may provide greater protection at high impact forces or G's. It should further be appreciated that mechanical valve 190 may be provided on at least one air pouch 120 with or without any electronic components without departing from the present disclosure. It should also be appreciated that mechanical valve 190 may be provided in a form including, but not limited to, a spring-operated or pop-off valve, a disc, and a rupture mechanism.

Inflation of at least one inflatable air pouch 120 may provide increased protection from brain trauma during impact by providing more cushioning and/or an optimal amount of cushioning around a user's head than conventional helmets. The optimal amount of cushioning may be determined by calculating the force that may be generated by an impact. Force gauge 122 and/or rupture disc 126 may measure the force that may be generated at impact. It should be appreciated that force gauge 122 may be provided with off-the-shelf components including, but not limited to, transistors, resistors, capacitors, batteries, micro universal serial bus (USB) plugs, miniature air cylinders, and miniature inflating charge devices. It should be appreciated that the pressure of at least one air pouch 120 may be at least twice an initial air pressure or normal air pressure in some embodiments of the present disclosure.

According to an embodiment of the present disclosure, helmet 110 may automatically return the air pressure of at least one inflatable air pouch 120 to a normal inflation after sustaining an impact against another object. Normal inflation may be an amount of inflation prior to sustaining an impact. It should be appreciated that helmet 110 may be re-inflated to a normal inflation without departing from the present disclosure. Nominal inflation may occur within approximately 0.01 to 0.5 seconds following impact against a hard surface. It should further be appreciated that a hard surface in which helmet 110 may make a hard impact may include, but is not limited to, the ground, an object, a wall, a person or an extension of a person, and/or another helmet system or helmet. It should be appreciated that an inflation time may be shorter or longer without departing from the present disclosure. A preset air pouch pressure may provide more protection to a user wearing helmet 110 at a force that may be higher than a force in which conventional helmets may be constructed to protect users.

It should be appreciated that inflation of at least one inflatable air pouch 120 may add little weight to helmet 110 and may decrease risks of injury to users. It should be appreciated that use of interactive helmet system 100 may eliminate a need for a spare helmet that may be required when factory-installed conventional air pockets in conventional helmets depressurize and/or become damaged after impact against a surface. It should be appreciated that interactive helmet system 100 may only require replacement of components including at least one inflatable air pouch 120, force gauge 122, pressure sensor 132, pressure regulator 134, at least one valve 130, at least one filler port 140, inflation device 150, and/or strap 152 following an impact against a surface, as opposed to providing an entirely new helmet. At least one inflatable air pouch 120 may be incorporated into helmet 110 using a simple manufacturing process that may include bonding, mechanically fastening, and/or molding at least one inflatable air pouch 120, force gauge 122, rupture disc 126, pressure sensor 132, pressure regulator 134, at least one valve 130, at least one filler port 140, inflation device 150, and/or strap 152 to portions of helmet 110.

It should be appreciated that at least one inflatable air pouch 120 may be incorporated into any type of helmet including, but not limited to, athletic helmets, hats, and non-athletic headgear including, but not limited to, occupational hard hats and recreational hats, and at least one inflatable air pouch 120 may be utilized in any sport or activity where helmets are used. At least one inflatable air pouch 120 may be provided on top of and/or under factory-installed air pockets. Following an impact against a surface, at least one inflatable air pouch 120 may be removed from helmet 110 and may be replaced with new components including, but not limited to, at least one inflatable air pouch 120, force gauge 122, rupture disc 126, pressure sensor 132, pressure regulator 134, at least one valve 130, at least one filler port 140, inflation device 150, and/or strap 152 to portions of helmet 110. It should be appreciated that these components may provide a system that has not been activated prior to sustaining impact against a surface. It should further be appreciated that at least one inflatable air pouch 120 may release air when interactive helmet system 100 is not being worn to provide easier removal of at least one inflatable air pouch 120 from helmet 110.

According to an embodiment of the present disclosure, at least one inflatable air pouch 120 may be provided in standard, as-purchased, and off-the-shelf helmets that may also include air pockets, bags, and/or bladders. It should be appreciated that at least one inflatable air pouch 120 may be made of a material such as plastic or rubber without departing from the present disclosure. It should be appreciated that at least one inflatable air pouch 120 may be incorporated into helmets that include standard foam and/or rubber cushioning with no factory-installed air pockets. It should further be appreciated there may be embodiments of the present disclosure where the standard foam and/or rubber in a helmet may be removed and replaced with at least one inflatable air pouch 120 that may provide a capability of instant inflation. It should be appreciated that air pockets, pouches, bags, and/or bladders may be interchangeable with components that provide a capability of instant inflation. It should further be appreciated that materials including, but not limited to, foam, rubber, urethane, and/or other cushioning materials may be provided in interior 170 and/or exterior 172 of helmet 110. A chemical charge or a pressurized cylinder may provide instant inflation of at least one inflatable air pouch 120. It should be appreciated that a chemical charge may be provided by a device including, but not limited to, a carbon dioxide ($CO_2$) cartridge. Inflation device 150 may be positioned so that inflation device 150 does not interfere with at least one inflatable air pouch 120. It should be appreciated that a small battery may be mounted in inflation device 150 to provide power without departing from the present disclosure.

According to an embodiment of the present disclosure, at least one filler port 140 may be provided on top 174 or back 176 of helmet 110 that may provide a pathway to inflate at least one inflatable air pouch 120 with air. It should be appreciated that additional filler ports may be provided on helmet 110 without departing from the present disclosure. It should further be appreciated that at least one filler port 140 may be provided at any location along helmet without departing from the present disclosure. It should be appreciated that the OEM pressure of at least one air pouch 120 may be doubled in some embodiments of the present disclosure. It should be appreciated that more or less pressure than approximately twice the OEM pressure may be added to at least one air pouch 120 without departing from the present disclosure. It should further be appreciated that the air pouch pressure may be increased to provide impact protection of up to approximately 100 G's without departing from the present disclosure. It should be appreciated that the inflation capability of at least one air pouch 120 may not be inflated over twice the OEM standard factory pressure or setting for safety precautions without departing from the present disclosure.

It should be appreciated that an analog inflation device may be provided in some embodiments of the present disclosure. It should further be appreciated that a digital inflation device may be provided in helmet 110 in other embodiments of the present disclosure. It should be appreciated that a mechanical non-electronic device may cause inflation of an air pressure cylinder that may be mechanically ruptured upon exertion and/or detection of impact G's. It should be appreciated that a mechanical non-electronic device may be rupture disc 126 that may be provided to inflate at least one inflatable air pouch 120 without departing from the present disclosure. It should be appreciated that at least one inflatable air pouch 120 may remain inflated in an active position without depressurizing or deflating. Instant inflation of at least one inflatable air pouch 120 may be triggered by an accelerometer that may be secured or fastened to a helmet shell. It should be appreciated that instant inflation of at least one inflatable air pouch 120 may be triggered by rupture disc 126 that may be secured or fastened to interior 170 of helmet 110. It should be appreciated that the helmet may be deflated whether or not worn by a user. Also, new inflatable air pouches may be installed in place of used inflatable air pouches. Inflation device 150 may inflate at least one inflatable air pouch 120 in various manners such as a chemical reaction that may occur and fill air pouch with a gas and use of a pressurized cylinder that may include carbon dioxide and/or a gas, and/or rupture disc 126. An inflation device for controlling and inflating at least one inflatable air pouch 120 may actuate mechanically without utilizing electronics upon helmet 110 undergoing a predetermined impact force.

It should be appreciated that at least one inflatable air pouch 120 may have a pressure release that may release pressure in at least one inflatable air pouch 120 after an interactive inflation event occurs including, but not limited to, impact with the ground, an object, a wall, a person or an extension of a person, and/or another helmet system or helmet. It should be appreciated that the pressure release may release excess pressure, so that an amount of pressure may return to an original amount of pressure that may have been provided in at least one inflatable air pouch 120 prior to the interactive inflation event. It should further be appreciated that the release of excess pressure by the pressure release may allow the interactive helmet to be quickly removed from a user's head and may prevent the user from experiencing discomfort from a high pressure that may result following the interactive inflation event. It should be appreciated that the pressure release may eliminate a need for manual deflation of at least one inflatable air pouch 120 using an inflation needle when an over-inflation of the interactive helmet may be present after an interactive inflation event occurs.

It should be appreciated that helmet 100 may provide an internal helmet cushioning material that may harden and/or soften as an electrical current may be applied to the helmet cushioning material. It should be appreciated that an internal liner cushioning material may harden as an impact increases, that such as an impact that may result from physical forces that may be applied to a helmet. It should further be appreciated that an internal liner cushioning material may harden due to an increase in physical force alone that may be applied to a helmet in the absence of mechanical devices and/or electronics in some embodiments of the present disclosure. It should be appreciated that an internal liner cushioning may utilize a pressure-seeking fluid in which the harder an impact that may be applied to helmet 100 is, the harder and/or stiffer the internal liner cushioning may become. It should be appreciated that the more fluid that may flow into cushioning material as a pressure increases may result in an increase in the hardness and/or stiffness of internal liner cushioning in embodiments of the present disclosure.

It should be appreciated that an interactive helmet system and method according to embodiments of the present disclosure may reduce brain injuries that may result from head impacts during activities including, but not limited to, football, motorbike riding, baseball, soccer, volleyball, rugby, boxing, wrestling, and other activities including sporting, occupational, recreational, and/or military activities.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An interactive helmet system for reducing brain injuries, comprising:

at least one inflatable air pouch provided in an interior of a helmet and in an active position prior to an impact of the helmet against a surface, the at least one inflatable air pouch adapted to reduce injuries to the brain and prevent concussions, wherein an air pouch pressure increases over a predetermined inflation time, wherein the predetermined inflation time is a time selected between 0.01 to 0.5 seconds following the impact of the helmet against the surface, and wherein the air pressure of the at least one inflatable air pouch is monitored so that the at least one inflatable air pouch provided in the interior of the helmet remains at least partially inflated and in the active position;

a force measuring instrument provided in the interior of the helmet and a pressure regulator provided in the interior of the helmet, the force measuring instrument arranged adjacent to the pressure regulator, wherein the force measuring instrument predetermines an impact force of the helmet against a surface, wherein the force measuring instrument contacts a crown of a user's head when the helmet is worn on the user's head, and wherein the air pouch pressure increases in proportion to the force; and an inflation device provided in the interior of the helmet to initiate inflating the at least one inflatable air pouch to a preset higher pressure after the inflation device provides a signal to at least one valve, wherein the at least one valve is provided in the interior of the helmet proximate the inflation device.

2. The interactive helmet system of claim 1, further comprising:

a pressure sensor provided in the interior of the helmet to signal the inflation device to initiate inflation of the at least one inflatable air pouch to a predetermined pressure, wherein the pressure regulator controls and maintains the air pouch pressure at or above the predetermined pressure, and wherein the air pouch pressure increases to a maximum of approximately twice the predetermined pressure.

3. The interactive helmet system of claim 1, wherein the inflation device provides the signal to the at least one valve to control a flow of gas into the at least one inflatable air pouch.

4. The interactive helmet system of claim 1, further comprising:

additional inflatable air pouches provided in the interior of the helmet in the active position.

5. The interactive helmet system of claim 1, wherein the inflation device is actuated mechanically without utilizing electronics upon undergoing the predetermined impact force.

6. The interactive helmet system of claim 1, further comprising:

a strap provided to support at least one of a user's chin and jaw, wherein the strap includes at least one inflatable air pouch located on the strap, and wherein the helmet and the strap are arranged to prevent injuries.

7. A method of reducing brain injuries using an interactive helmet system, comprising:

arranging at least one inflatable air pouch in an active position prior to an impact of the helmet against a surface and in an interior of a helmet adapted to reduce injuries to the brain and prevent concussions;

arranging a force measuring instrument and a pressure regulator in the interior of the helmet, the force measuring instrument arranged adjacent the pressure regulator, wherein the force measuring instrument contacts a crown of a user's head when the helmet is worn on the user's head;

predetermining an impact force of the helmet against the surface using the force measuring instrument, wherein an air pouch pressure increases in proportion to the impact force;

providing a signal to at least one valve using an inflation device, wherein the at least one valve is provided in the interior of the helmet proximate the inflation device; and initiating inflation of the at least one inflatable air pouch using the inflation device, wherein inflation occurs over a predetermined inflation time to a preset higher pressure after the at least one valve receives the signal, and wherein the predetermined inflation time is a time selected between 0.01 to 0.5 seconds following the impact of the helmet against the surface.

8. The method of claim 7, further comprising:

monitoring the air pouch pressure of the at least one inflatable air pouch provided in the interior of the helmet after initiating inflation using a pressure sensor, wherein the pressure sensor signals the inflation device to initiate inflation of the at least one inflatable air pouch to a predetermined pressure; and maintaining the air pouch pressure at or above the predetermined pressure using the pressure regulator.

9. The method of claim 7, further comprising:

providing the signal to the at least one valve using the inflation device to control a flow of air or gas into the at least one inflatable air pouch.

10. The method of claim 7, further comprising:

arranging additional inflatable air pouches in the interior of the helmet and in the active position.

11. The method of claim 7, wherein the inflation device is actuated mechanically without utilizing electronics upon undergoing the predetermined impact force.

12. The method of claim 7, further comprising:

arranging an additional at least one inflatable air pouch in an active position in a strap provided to support at least one of a user's chin and jaw.

13. The method of claim 7, further comprising:

providing inflation of the at least one inflated air pouch with a chemical charge or a pressurized cylinder.

14. The method of claim 7, further comprising:

a flow of air or gas into the at least one inflatable air pouch using the inflation device and mounting a small battery to the inflation device.

* * * * *